US005939821A

United States Patent [19]

Itou et al.

[11] Patent Number: 5,939,821

[45] Date of Patent: Aug. 17, 1999

[54] COLOR CATHODE RAY TUBE

[75] Inventors: Takeo Itou, Kumagaya; Hidemi Matsuda, Fukaya; Hajime Tanaka, Fujioka; Tomoko Nakazawa, Maebashi, all of Japan

[73] Assignee: Kabushiki Kaisha Toshiba, Kawasaki, Japan

[21] Appl. No.: 08/642,421

[22] Filed: May 3, 1996

[30] Foreign Application Priority Data

May 10, 1995 [JP] Japan ..... 7-112069

[51] Int. Cl.[6] ..... H01J 29/10; H01J 31/00; H01J 5/16; H01J 61/40

[52] U.S. Cl. ..... 313/461; 313/112; 313/474; 313/478; 313/479; 313/477 R

[58] Field of Search ..... 313/110, 112, 313/461, 467, 474, 477 R, 478, 480

[56] References Cited

U.S. PATENT DOCUMENTS

| | | | |
|---|---|---|---|
| 3,884,695 | 5/1975 | Gallaro et al. | 313/474 X |
| 3,886,394 | 5/1975 | Lipp | 313/474 X |
| 3,891,440 | 6/1975 | Gallaro et al. | 313/474 X |
| 4,135,112 | 1/1979 | Fisher et al. | 313/474 X |
| 4,185,220 | 1/1980 | Oberg | 313/478 |
| 4,310,784 | 1/1982 | Anthon et al. | 313/474 |
| 4,537,321 | 8/1985 | Tokita | 313/477 R X |
| 4,663,562 | 5/1987 | Miller | 313/474 X |
| 4,728,856 | 3/1988 | Iwasaki t al. | 313/467 |
| 4,734,761 | 3/1988 | Kondoh et al. | 313/461 X |
| 4,987,338 | 1/1991 | Itou et al. . | |
| 5,028,840 | 7/1991 | Uesaka et al. | 313/474 X |
| 5,121,030 | 6/1992 | Schott | 313/478 X |

FOREIGN PATENT DOCUMENTS

| | | |
|---|---|---|
| 0 432 744 | 6/1991 | European Pat. Off. . |
| 0518509A1 | 12/1992 | European Pat. Off. . |
| 0 647 690 | 4/1995 | European Pat. Off. . |
| 4345737 | 12/1992 | Japan . |
| 2 240 213 | 7/1991 | United Kingdom . |

OTHER PUBLICATIONS

Ohno et al, "A High–Picture–Quality Large–Area Color Display Improved by the Application of Ultrafine–Pigment Color Filters", SID International Symposium Digest of Technical Papers, vol. 25, Jun. 14, 1994, pp. 584–587.

Patent Abstracts of Japan, vol. 010, No. 058 (E–386), Mar. 7, 1986 & JP 60 211741A (Mitsubishi Denki KK), Oct. 24, 1985.

Patent Abstracts of Japan, vol. 006, No. 222 (E–140), Nov. 6, 1982 & JP 57 126053 A (Mitsubishi Denki KK), Aug. 5, 1982.

*Primary Examiner*—Sandra L. O'Shea
*Assistant Examiner*—Mack Haynes
*Attorney, Agent, or Firm*—Cushman Darby & Cushman IP Group of Pillsbury Madison & Sutro LLP

[57] ABSTRACT

A color cathode ray tube includes a faceplate and a phosphor screen provided on the inner surface of the faceplate and including red, green, and blue phosphor layers. A color filter layer is interposed between the inner surface of the faceplate and the phosphor screen. The color filter layer includes color filters opposed individually to the phosphor layers of the phosphor screen and having colors corresponding thereto. Color filters of each color have a higher transmittance for light beams with wavelengths which are in a range of ±20 nm of the maximum emission spectrum wavelength of the phosphor layers of the corresponding color than for light beams with wavelengths which are outside the range and which are between 400 nm and 650 nm. A common outside filter for complementing the light absorption properties of the color filters is provided on the outer surface of the faceplate and has a maximum absorption in a predetermined wavelength which is outside the maximum emission spectrum wavelengths of the red, green, and blue phosphor layers.

17 Claims, 4 Drawing Sheets

| | (d) | (b) | (a) |
|---|---|---|---|
| LUMINANCE (B) (%) | 120 | 88 | 100 |
| REFLECTANCE (R) (%) | 69 | 69 | 100 |
| CONTRAST [ =B/R ] | 174 (136) | 128 (100) | 100 (78) |
| COLOR REPRODUCTION AREA (U', V') | 112 | 105 | 100 |

COLOR CATHODE RAY TUBE

BACKGROUND OF THE INVENTION

1. Field of the Invention

The present invention relates to a color cathode ray tube, and more particularly, to a color cathode ray tube capable of ensuring high-luminance, high-contrast display.

2. Description of the Related Art

In general, a conventional color cathode ray tube comprises a transparent faceplate having an effective display region for displaying an image, a phosphor screen covering the inside of the effective display region of the faceplate, and a funnel whose front end portion is bonded to the rear side of the faceplate. The faceplate and the funnel constitute an envelope, which serves as a shell of the cathode ray tube. The rear end portion of the funnel forms a tapered neck, which contains an electron gun. The electron gun emits an electron beam on that portion of the phosphor screen which corresponds in position to the displayed image in a manner such that the phosphor screen is scanned with the electron beam.

The path of the electron beam emitted from the electron gun is controlled by means of a magnetic field generated by a deflecting yoke, which is arranged so as to surround the beam path. Thus, the electron beam is projected on a predetermined portion of the phosphor screen.

The brightness of the displayed image is one of important characteristics for the image quality of the a color cathode ray tube. Generally, the image brightness is evaluated by luminance and contrast characteristic.

The brightness and contrast of an image on a display screen visually recognized by an observer depends on the brightness of the surface of the display screen itself, as well as on the luminance of the displayed image. More specifically, the apparent brightness and contrast of the displayed image are settled depending on the sum total of the respective apparent brightness of reflected light from the display screen in a no-display state and the phosphor screen itself and the luminance of the displayed image from the phosphor screen.

The image display quality of the color cathode ray tube can be improved by improving the brightness and contrast of the displayed image.

It has been difficult, however, to improve the brightness and contrast concurrently using known techniques.

By improving the light transmittance of the faceplate by appropriately selecting its material, light emitted from the phosphor screen and projected on the front of the faceplate can be effectively utilized with high transmittance, and the displayed image can be brighter.

In the case where the faceplate of the high-transmittance material is used in this manner, the lightness of the nonluminous phosphor screen itself adds to the brightness of the display screen in the no-display state, in general. The contrast of an image, which is displayed as the phosphor screen is excited to glow, is settled depending on the correlation between the respective brightness of the displayed image and the display screen in the no-display state. The brighter the display screen in the no-display state, the lower the contrast characteristic of the displayed image. Since the color of the phosphor screen itself is based on white, in general, its lightness is very high. If the high-transmittance faceplate is used, therefore, the contrast of the displayed image tends to be lower.

Thus, in order to improve the luminance of the displayed image, according the conventional color cathode ray tube, a method is generally employed such that the driving voltage of the tube is raised to augment the energy of the electron beam, whereby the luminance of emission from the phosphor is enhanced.

Conventionally, the contrast characteristic is improved by a method in which the faceplate is formed of colored glass such that its light transmittance is not higher than 40%, for example, whereby the brightness of the display screen in the no-display state is lowered, or a method in which the phosphor is loaded with a pigment such that the phosphor screen itself is dark-colored.

If the electron beam energy is augmented, however, the power consumption of the whole color cathode ray tube increases, so that the economical efficiency is not very high.

If the faceplate is formed of colored glass such that its light transmittance is not higher than 40%, for example, the luminance of the displayed image lowers in proportion to the light transmittance of the faceplate, while the external light reflectance lowers in proportion to the square of the transmittance of the faceplate, so that the contrast characteristic of the displayed image is improved. If the light transmittance of the faceplate itself lowers, however, the transmittance of the light that is emitted from the phosphor screen and transmitted through the faceplate to form the image also lowers to 40% or less. As a result, the luminance of the displayed image is lowered considerably.

Recently, there has been provided a cathode ray tube with a "flattened" faceplate, which is shaped so that its thickness increases from its center toward the peripheral portion at the predetermined changing rate. In the color cathode ray tube of this type, the coefficient of absorption of the light that forms the displayed image is higher at the thickened peripheral portion of the faceplate, so that the luminance of the displayed image at the peripheral portion of the display screen greatly differs from the luminance at the central portion.

According to the color cathode ray tube using the "flattened" faceplate, making the thickness of the faceplate uniform throughout the display screen requires a special shape of a shadow mask in the tube and special methods for scanning electron beams and manufacturing the whole cathode ray tube. Thus, there are so many restrictions on manufacture and construction that it is very hard practically to make the faceplate uniform in thickness.

Possibly, the contrast characteristic may be improved by loading the phosphor with a pigment to darken the phosphor screen itself. Since the pigment is not a phosphor, however, the percentage of compositions that are not conducive to emission in the phosphor screen is so high that the emission efficiency of the phosphor layer itself is lowered. In consequence, the luminance of the displayed image is lowered.

Alternatively, the emission in the phosphor screen may be enhanced by increasing voltage for emitting the electron beam from the electron gun to augment the energy of the electron beam. In this case, however, the power consumption increases, and voltage for deflecting the high-energy electron beam must be increased, thus requiring an additional increase in the power consumption. After all, the power consumption of the whole color cathode ray tube is increased considerably.

In order to solve the above problems, a novel technique or method has been proposed in which a color filter layer is interposed between the inner surface of the faceplate and the phosphor screen. Recently, this method has come to public notice.

The color filter layer includes a plurality of color filters, which are opposed to phosphor dots or stripes that form differently colored pixels of the phosphor screen. Each filter transmits only light beams having the color of its corresponding pixel. Arranged in this manner, the color filter layer projects only those emitted light beams which correspond to the color of each pixel on the faceplate, and prevents external light from being reflected by the interface between the phosphor screen and the faceplate. Thus, the contrast characteristic is believed to be able to be effectively improved without lowering the chromaticity of the luminous spots of different colors on the display screen, that is, the color intensity of the emitted light beams, or the luminance of the display screen.

Since the color filter layer is disposed on the inner surface of the faceplate, however, its material is restricted to a heat-resisting transparent material, such as an inorganic pigment, that can stand the internal environment of the color cathode ray tube. Due to this restriction on the material, the color filter layer cannot always enjoy optimum filtering characteristics for satisfactory filter functions.

Among the luminous spots of different colors that constitute the image displayed on the display screen, red spots R have the greatest influence on the quality of reproduction of the image. The spectrum distribution of red light beams emitted from the red spots R or phosphors corresponding to red is very narrow and sharp, and the color intensity of the light beams emitted from the spots R is higher if the spectra are displayed without change.

In the case where the aforesaid color filter layer is used, however, the red spots R on the display screen are represented as light beams of a color that resemble the spectra of red light from the phosphors to some degree. In the existing circumstances, however, the emission spectra of the red spots involve great sub-bands that are attributable to the characteristics of the color filter layer. Inevitably, therefore, the red spots of the displayed image are recognized as low-intensity luminous spots by the observer. This problem on the color intensity is common to all colors including green (G) and blue (B) as well as red (R).

Thus, the prior art color cathode ray tube has a problem that satisfactory improvement of the luminance and contrast characteristic of the effective display region is incompatible with improvement of the lightness and color intensity of the luminous spots of the individual colors, including red, on the displayed image.

SUMMARY OF THE INVENTION

The present invention has been contrived in consideration of these circumstances, and its object is to provide a color cathode ray tube, in which the luminance and contrast characteristic of the effective display region and the color intensity can be improved consistently, whereby high-quality display is ensured.

In order to achieve the above object, a color cathode ray tube according to the present invention comprises: an envelope including a faceplate having inner and outer surfaces and a funnel fixed to the faceplate and having a neck; a phosphor screen provided on the inner surface of the faceplate and including three color phosphor layers arranged in a predetermined pattern; an electron gun in the neck for applying an electron beam to the phosphor screen so that the phosphor screen emits light; a color filter layer interposed between the inner surface of the faceplate and the phosphor screen, the color filter layer including color filters opposed to phosphor layers of at least one color, the color filters having a higher transmittance for light beams with wavelengths which are in a range of ±70 nm of the maximum emission spectrum wavelength of the phosphor layers of the at least one color than for light beams with wavelengths which are outside the range and which are between 400 nm and 650 nm; and correction means arranged outside and opposite the color filter layer and having a maximum absorption in a predetermined wavelength which is outside the range, for complementing the light absorption properties of the color filters.

According to the present invention, the correction means includes an outside filter formed on the outer surface of the faceplate.

According to another invention, the faceplate is formed of neodymium glass and constitutes the correction means.

The faceplate is substantially rectangular in shape and has a thickness gradually increasing from the center thereof toward the peripheral portion at a predetermined changing rate.

According to the color cathode ray tube of the invention constructed in this manner, external light is primarily absorbed by the correction means that is opposed to the color filter layer. Among those components of the external light which are transmitted through the faceplate without being absorbed by the correction means, light beams of other colors than the color of at least one phosphor are absorbed by the color filters of the color filter layer formed on the inner surface of the faceplate. This absorption will be referred to as second-stage external light absorption hereinafter.

Those components of the external light which remain unabsorbed after the second-stage external absorption run again into the color filter layer to be absorbed thereby as they return to the front side after being reflected by the surface of the phosphor layer. This absorption will be referred to as third-stage absorption hereinafter. Moreover, those components of the external light which remain unabsorbed after the third-stage external light absorption are absorbed again by the correction means. This absorption will be referred to as fourth-stage external light absorption hereinafter.

In the first to fourth stages of external light absorption described above, external light beams incident on the faceplate of the color cathode ray tube can be absorbed highly effectively. On the other hand, the differently colored light beams from the phosphors for forming the displayed image can be transmitted through the color filter layer with high transmittances. Thus, based on various experiments, the inventors hereof confirmed that images can be displayed whose contrast and luminance appear to be high to the eyes of an observer.

Accordingly, the contrast characteristic and luminance of the display screen can be improved consistently without depending on light absorption by the faceplate itself. Sub-band portions for light beams of at least one color can be absorbed by means of the color filter of the color filter layer and the correction means, so that color purity of that color is improved.

According to the color cathode ray tube of the present invention, furthermore, the contrast and luminance are improved by simply combining the first to fourth stages of external light absorption in the aforementioned manner, and besides, the respective spectrum distributions of luminous spots of different colors in the displayed image can be made more similar to the respective emission spectrum distributions of the phosphors of the corresponding colors than in the conventional case. Accordingly, the color reproducibility of the displayed image is satisfactory. Thus, sub-bands for the light beams of the individual colors can be made narrower than in the conventional case, so that high-quality color images can be displayed with improved color purity.

Also in a color cathode ray tube using a "flattened" faceplate, which is shaped so that its thickness increases from its center toward the peripheral portion at a predetermined changing rate, the contrast characteristic and luminance of the display screen can be improved consistently, and rendered uniform throughout the area ranging from the central portion of the display screen to the peripheral portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIGS. 1 and 2 show a color cathode ray tube according to an embodiment of the present invention, in which:

FIG. 1 is a sectional view of the color cathode ray tube, and

FIG. 2 is an enlarged sectional view showing part of a faceplate of the color cathode ray tube;

DETAILED DESCRIPTION OF THE PREFERRED EMBODIMENT

A color cathode ray tube according to an embodiment of the present invention will now be described in detail with reference to the accompanying drawings.

Figure 1:
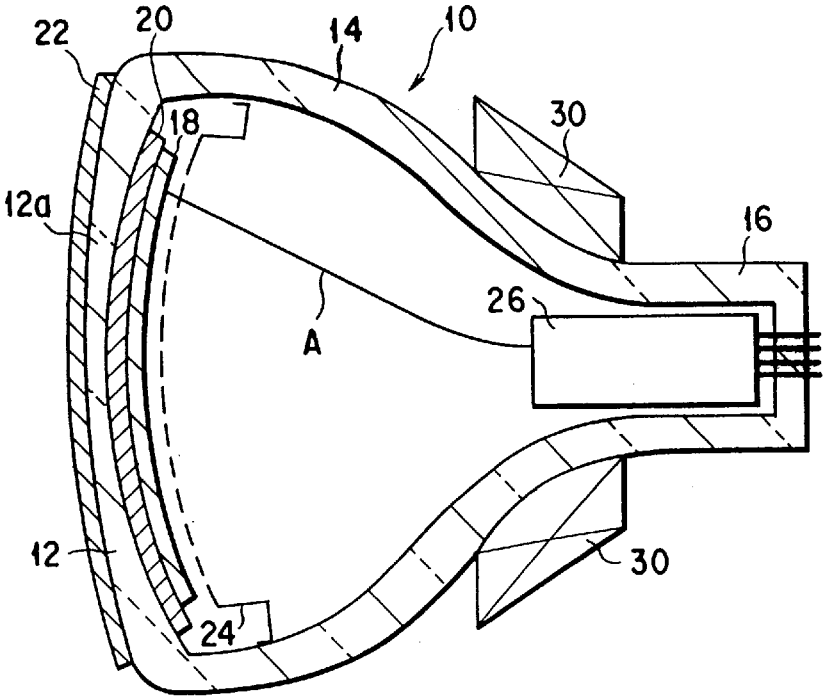

First, an outline of the construction of the color cathode ray tube will be described in brief. As shown in FIG. 1, the color cathode ray tube comprises a substantially rectangular faceplate 12 and a funnel 14, which constitute a sealed envelope 10. The faceplate 12 has a rectangular effective display region 12*a* for displaying an image, and is formed so that its thickness increases from its center toward the peripheral portion at a predetermined changing rate. The outer surface of the faceplate 12 is substantially flat.

The front end portion of the funnel 14 is bonded to the peripheral edge portion of the back of the faceplate 12. The rear end portion of the funnel 14 constitutes a tapered neck 16.

A phosphor screen 18 including phosphor layers of different three colors, red, green, and blue, is formed on the inner surface of the faceplate 12 so as to face the effective display region 12*a*. A color filter layer 20 is interposed between the inner surface of the faceplate 12 and the phosphor screen 18. Further, a common outside filter 22, for use as correction means, is formed on the outer surface of the faceplate 12 so as to cover the effective display region 12*a*.

A shadow mask 24 is disposed in the envelope 10 and is opposed to the phosphor screen 18. Located in the neck 16 of the funnel 14, moreover, is an electron gun 26, which applies an electron beam A to the screen 18 through the mask 24. A deflecting yoke 30 is mounted on the outer peripheral surface of the funnel 14. The electron beam A emitted from the electron gun 26 is deflected in horizontal and vertical directions by magnetic fields that are generated by the deflecting yoke 30, and is used to scan the phosphor screen 18.

On the other hand, the faceplate 12 is formed of glass with a high transmittance of 65% that looks gray. Although light from a displayed image is absorbed at a rate of about 35% by the faceplate 12, therefore, this never leads to a substantial reduction in the apparent luminance of the displayed image.

Figure 2:
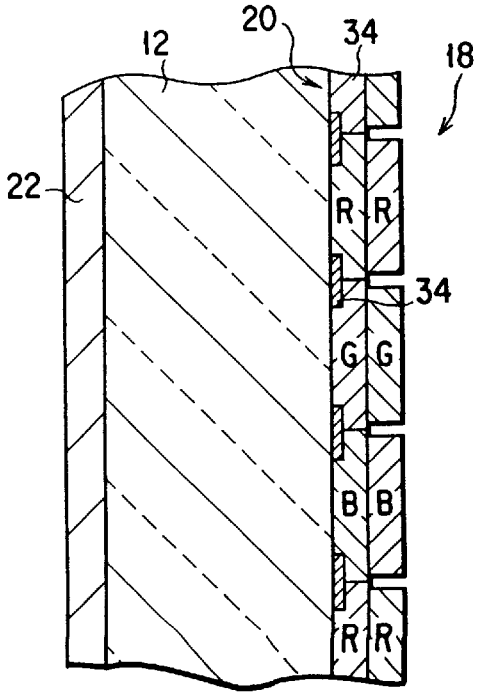

As shown in FIG. 2, the red, green, and blue phosphor layers R, G and B of the phosphor screen 18 have the shape of a stripe each, and are arranged extending parallel to one another. The thickness of the phosphor screen 18 ranges from about 5 to 20 $\mu$m. Each phosphor layer is not limited to the shape of a stripe, and may alternatively be dot-shaped.

A shading layer (black matrix) 34 of a black pigment is formed on the inner surface of the faceplate 12 so as to face gaps between the adjacent phosphor layers of the phosphor screen 18. The thickness of the shading layer 34 is set within the range of about 0.5 to 1.0 $\mu$m. Particles of black material, such as graphite, having an average diameter of 0.2 to 0.5 $\mu$m may be suitably used as the black pigment for the shading layer 34.

The color filter layer 20, which is interposed between the faceplate 12 and the phosphor screen 18, includes red, green, and blue stripe-shaped filters R. G and B, which are arranged extending parallel to one another. The red, green, and blue filters R, G and B are formed and arranged so as to face the phosphor layers R, G and B of the phosphor screen 18, respectively. The thickness of the color filter layer 20 is set within the range of about 0.05 to 1.0 $\mu$m.

In the case where each phosphor layer of the phosphor screen 18 is dot-shaped, each filter of the color filter layer 20 is also dot-shaped correspondingly.

The following is a description of a preferred example of the pigment that is used for the color filter layer 20.

In the present embodiment, the filters R, G and B of the color filter layer 20 are formed using pigments with average particle diameters of 0.0001 to 0.07 $\mu$m.

Available pigments for the red filter R include Sicotrans Red L-2817 (particle diameter: 0.01 to 0.02 $\mu$m; from BASF Inc.) based on ferric oxide, Cromophthal Red A2B (particle diameter: 0.01 $\mu$m; from Ciba-Geigy Inc.) based on anthraquinone, etc.

Available pigments for the green filter G include Dypyroxide TM Green #3320 (particle diameter: 0.01 to 0.02 $\mu$m;

from Dainichi Seika Inc.) based on $TiO_2$—NiO—CoO—ZnO, Dypyroxide TM Green #3340 (particle diameter: 0.01 to 0.02 μm; from Dainichi Seika Inc.) based on CoO—$Al_2O_3$—$Cr_2O_3$—$Cr_2O_3$—$TiO_2$, Dypyroxide TM Green #3420 (particle diameter: 0.01 to 0.02 μm; from Dainich Seika Inc.) based on CoO—$Al_2O_3$—$Cr_2O_3$—$Cr_2O_3$, Fastogen Green S (particle diameter: 0.01 μm; from Dainippon Ink & Chemicals, Inc.) based on chlorinated phthalocyanine green, Fastogen Green 2YK (particle diameter: 0.01 μm; from Dainippon Ink & Chemicals, Inc.) based on brominated phthalocyanine green, etc.

Available pigments for the blue filter G include Cobalt Blue X (particle diameter: 0.01 to 0.02 μm; from Toyo-Ganryo Inc.) based on cobalt (II) aluminate ($Al_2O_3$—CoO), Lionol Blue FG-7370 (particle diameter: 0.01 μm; from Toyo Ink Mfg. Co., Ltd.) based on phthalocyanine blue, etc.

The common outside filter 22, which is formed on the outer surface of the faceplate 12, is opposed to all the filters R, G and B of the color filter layer 20. The filter 22 has a thickness of 0.01 to 0.05 μm, and is formed of silicone containing an organic pigment or dye. For example, an indium pigment may be suitably used as the organic pigment, and a rhodamine or xanthene dye as the organic die.

Figure 3A:
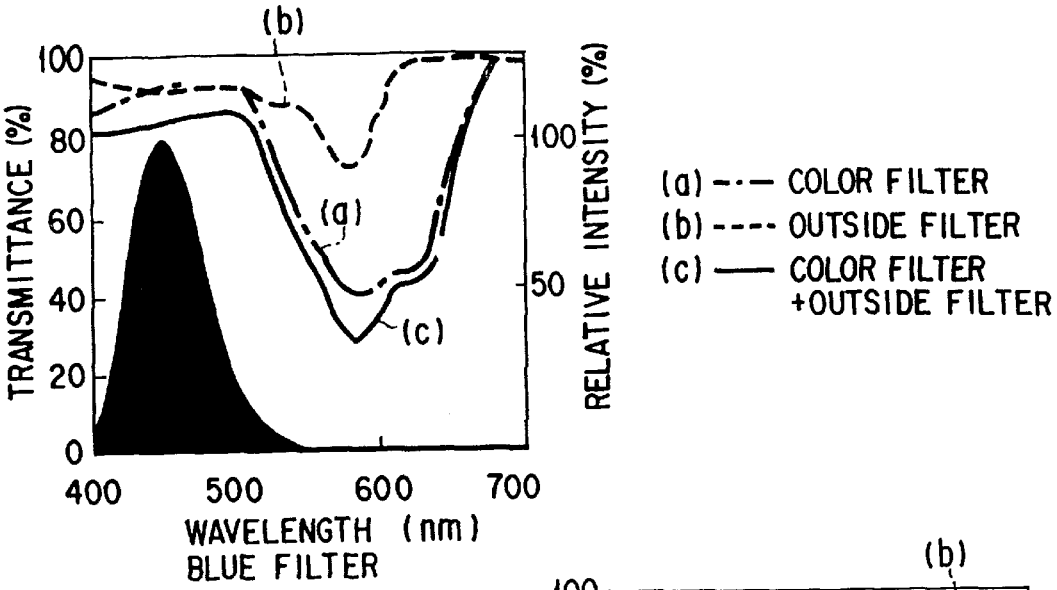
FIGS. 3A, 3B and 3C show characteristic curves representing light absorption spectra of blue, green, and red color filters, respectively, of the color cathode ray tube, along with light absorption spectra of a common outside filter.
Figure 3B:
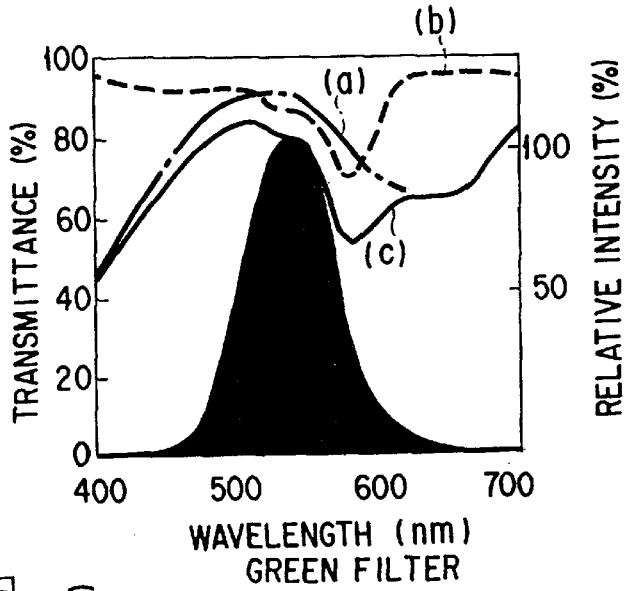
Figure 3C:
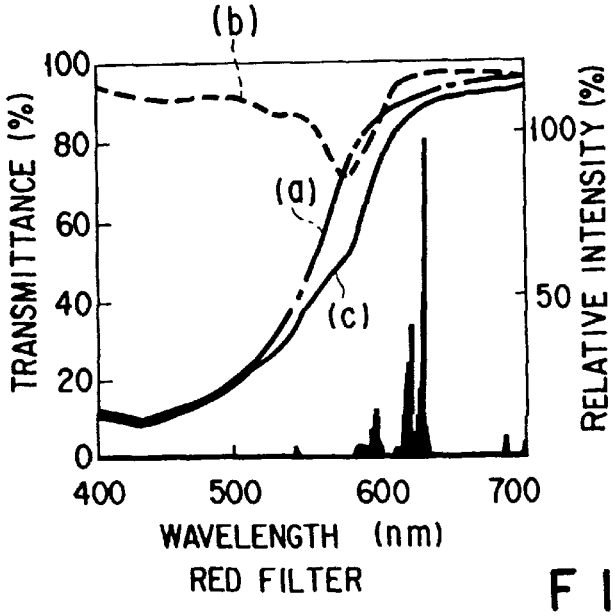

The color filter layer 20 and the common outside filter 22 constructed in this manner have the filtering characteristics, that is, light transmission and absorption properties, shown in FIGS. 3A, 3B and 3C.

In FIG. 3A, dots and dashed-line curve (a) and broken-line curve (b) represent the absorption spectra of the blue filter B of the color filter layer 20 and the common outside filter 22, respectively, and the solid black region represents an emission spectrum distribution of the blue phosphor.

As seen from FIG. 3A, the blue filter B has a transmittance of 70% or more for light beams with wavelengths in a range of ±20 of the maximum emission spectrum wavelength of the blue phosphor, for example, wavelengths near 450 nm, while it has a transmittance of about 40% for light beams with wavelengths in any other spectral bands, that is, green and red spectral bands, and intensively absorbs external light in the vicinity of those bands. The average transmittance for light beams with wavelengths of 500 to 600 nm, in particular, ranges from about 5 to 65%.

Thus, the blue filter B is designed so that it efficiently transmits light beams in the spectral band of the blue phosphor layer B opposite thereto, and selectively absorbs light beams in the other bands.

On the other hand, the common outside filter 22 has its maximum absorption in the wavelength range of 500 to 600 nm, more specifically, 575±20 nm, with which the eyes of an observer can enjoy the highest visual-sensitivity, and has a transmittance of 50 to 90% for light beams with wavelengths in this range. Thus, the filter 22 selectively absorbs external light in a high visual-sensitivity band, and efficiently transmits light beams in any other bands.

If the blue filter B and the common outside filter 22 are combined together, the filtering characteristics of the blue filter can be corrected by the common filter, and the absorption spectrum of the combination of these filters becomes more similar to the emission spectrum distribution of the blue phosphor, as indicated by full-line curve (c) in FIG. 3A. Thus, external light in a high visual-sensitivity band can be efficiently absorbed by lowering the transmittance for them without substantially lowering the transmittance for blue display light beams. At the same time, sub-band portions for blue light emitted from the phosphor can be absorbed.

In FIG. 3B, dots and dashed-line curve (a) and broken-line curve (b) represent the absorption spectra of the green filter G of the color filter layer 20 and the common outside filter 22, respectively, and the solid black region represents an emission spectrum distribution of the green phosphor.

As seen from FIG. 3B, the green filter G has a transmittance of 70% or more for light beams with wavelengths in a range of ±20 of the maximum emission spectrum wavelength of the green phosphor, for example, wavelengths near 530 nm, while it has a transmittance of about 40% for light beams with wavelengths in any other spectral bands, that is, blue and red spectral bands, and intensively absorbs external light in the vicinity of those bands. The average transmittance for light beams with wavelengths of 500 to 600 nm, in particular, ranges from about 5 to 65%.

Thus, the green filter G is designed so that it efficiently transmits light beams in the spectral band of the green phosphor layer G opposite thereto, and selectively absorbs light beams in the other bands.

If the green filter G and the common outside filter 22 are combined together, the filtering characteristics of the green filter can be corrected by the common filter, and the absorption spectrum of the combination of these filters becomes more similar to the emission spectrum distribution of the green phosphor, as indicated by full-line curve (c) in FIG. 3B. Thus, external light in a high visual-sensitivity band can be efficiently absorbed by lowering the transmittance for them without substantially lowering the transmittance for green display light beams. At the same time, sub-band portions for green light emitted from the phosphor can be absorbed.

In FIG. 3C, dots and dashed-line curve (a) and broken-line curve (b) represent the absorption spectra of the red filter R of the color filter layer 20 and the common outside filter 22, respectively, and the solid black region represents an emission spectrum distribution of the red phosphor.

As seen from FIG. 3C, the red filter R has a transmittance of 70% or more for light beams with wavelengths in a range of ±20 of the maximum emission spectrum wavelength of the red phosphor, for example, wavelengths near 627 nm, while it has a transmittance of about 40% for light beams with wavelengths in any other spectral bands, that is, blue and green spectral bands, and intensively absorbs external light in the vicinity of those bands. The average transmittance for light beams with wavelengths of 500 to 600 nm, in particular, ranges from about 5 to 65%.

Thus, the red filter R is designed so that it efficiently transmits light beams in the spectral band of the red phosphor layer R opposite thereto, and selectively absorbs light beams in the other bands.

If the red filter R and the common outside filter 22 are combined together, the filtering characteristics of the red filter can be corrected by the common filter, and the absorption spectrum of the combination of these filters becomes more similar to the emission spectrum distribution of the red phosphor, as indicated by full-line curve (c) in FIG. 3C. Thus, external light in a high visual-sensitivity band can be efficiently absorbed by lowering the transmittance for them without substantially lowering the transmittance for red display light beams. At the same time, sub-band portions for red light emitted from the phosphor can be absorbed.

In the color cathode ray tube constructed in this manner, external light incident upon the faceplate 12 is absorbed by the common outside filter 22 that is common to the filters of the different colors. This absorption will be referred to as first-stage absorption hereinafter. The external light is absorbed at about 5 to 35% by this first-stage absorption.

Light beams transmitted through the faceplate 12 without being absorbed by the common outside filter 22 are absorbed by the color filter layer 20 on the inner surface of the faceplate 12. In this case, each color filter absorbs light beams in the bands of other colors than its corresponding color. This absorption will be referred to as second-stage external light absorption hereinafter. In the process of this second-stage absorption, the color filter layer 20 further absorbs the remaining components of the external light at about 5 to 60%.

Those components of the external light which remain unabsorbed after the second-stage external absorption is reflected by the surface of the phosphor screen 18 and run again into the color filter layer 20 to be absorbed thereby as they return to the faceplate side. This absorption will be referred to as third-stage absorption hereinafter. In the process of this third-stage absorption, the remaining components of the external light are further absorbed at about 15 to 60%.

Moreover, those components of the external light which remain unabsorbed after the third-stage external light absorption are absorbed again by the common outside filter 22. This absorption will be referred to as fourth-stage external light absorption hereinafter. In the process of this fourth-stage absorption, the remaining components of the external light are further absorbed at about 5 to 35%.

In the first to fourth stages of external light absorption described above, external light beams reflected by the inner and outer surfaces of the faceplate 12 of the color cathode ray tube can be absorbed highly effectively. On the other hand, the differently colored light beams of the displayed image, which is formed by the emission of light from the phosphor screen 18, can be transmitted through their corresponding filters R, G and B of the color filter layer 20 and the common outside filter 22 with high transmittances. Thus, images can be displayed whose contrast and luminance appear to be high to the observer's eyes.

In order to confirm the effect of improvement of the contrast and luminance, the inventors hereof comparatively examined the color cathode ray tube (d) according to the present embodiment, which is provided with the color filter layer 20 and the common outside filter 22, a color cathode ray tube (a) having no filters, a color cathode ray tube (b) having an outside filter only, and a color cathode ray tube (c) having a color filter layer only.

Figures 4, 5:
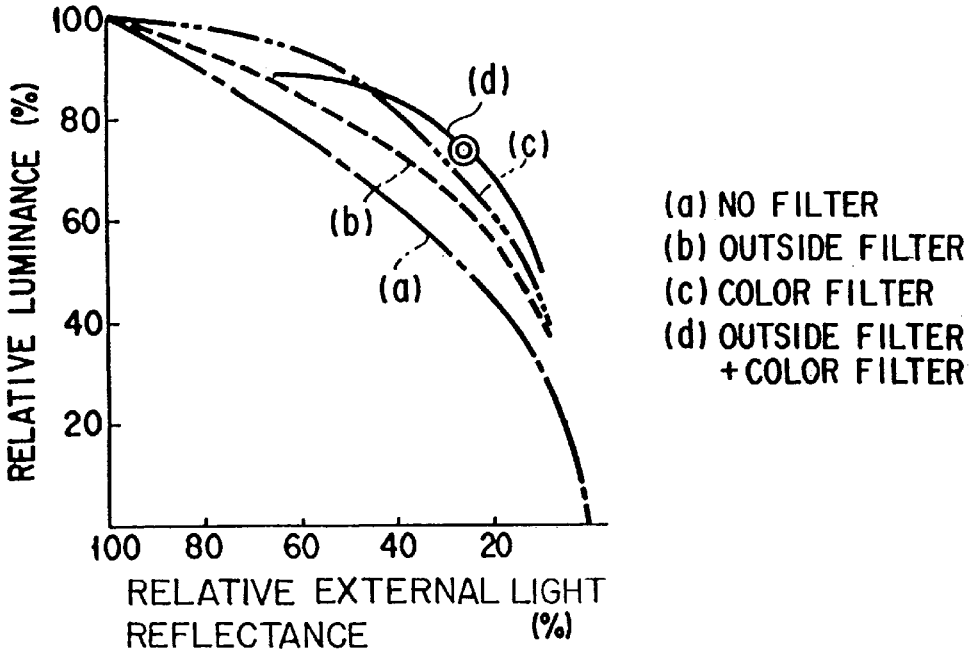
FIG. 4 shows characteristic curves representing the relationships between the relative luminance and relative external light reflectance of the color cathode ray tube shown in FIGS. 1 and 2 and other color cathode ray tubes.
FIG. 5 is a diagram showing the results of comparison between the various color cathode ray tubes shown in FIG. 4 for various characteristics.

FIG. 4 shows the relationships between the relative luminance and relative external light reflectance of the respective effective display screens of the color cathode ray tube described above. FIG. 5 shows the results of comparison between the color cathode ray tubes for the luminance, contrast, etc. of monitored displayed images.

In FIG. 4, dots and dashed-line curve (a) represents characteristics of the color cathode ray tube (a) whose contrast is improved by making the light transmittance of the faceplate lower than in the case of the present embodiment, broke-line curve (b) represents characteristics of the color cathode ray tube (b) having the outside filter only, two dots and dashed-line curve (c) represents characteristics of the color cathode ray tube (c) having the color filter layer only, and full-line curve (d) represents characteristics of the color cathode ray tube (d) according to the present embodiment.

In FIG. 5, luminance (B), reflectance (R), contrast (B/R), and color reproduction area for the color cathode ray tubes (b) and (d) are given by values compared with 100% (reference value) for the color cathode ray tube (a). The parenthesized values in the columns for contrast are values compared with 100% for the color cathode ray tube (b).

As seen from FIGS. 4 and 5, both luminance and contrast are lowest in the case of the color cathode ray tube (a) having no filters. In the color cathode ray tube (b) having the common outside filter only, as compared with the color cathode ray tube (a), the contrast is not high enough, although somewhat improved, and the luminance is low.

In the case of the color cathode ray tube (c) having the color filter layer only, the relative luminance is low in the region where the relative reflectance is low, as indicated by curve (c), so that the luminance is lowered if the contrast characteristic is improved.

In the case of the color cathode ray tube according to the present embodiment, on the other hand, the relative luminance is high enough in the region where the relative reflectance is low enough to effectively improve the image quality, that is, where the relative reflectance is 40% or less, as indicated by curve (d). This indicates that the contrast characteristic and luminance can be improved concurrently.

According to the color cathode ray tube of the present embodiment, moreover, the contrast and luminance are improved by simply combining the first to fourth stages of external light absorption in the aforementioned manner. By combining the color filter layer and the common outside filter, besides this, the respective absorption spectrum distributions of those filters for luminous spots of the individual colors can be made more similar to the respective emission spectrum distributions of the phosphors of the corresponding colors.

For example, the spectrum distribution for spots R on the displayed image can be made more similar to the sharp emission spectrum distribution of the red phosphor than in the conventional case. By doing this, red emission from the displayed image can be visually recognized as a color image with much higher purity than conventional ones. FIG. 3C also indicates this effect.

As indicated by full-line curve (c) in FIG. 3C, the filtering characteristics or absorption spectra for the case where the red filter is combined with the common outside filter are much sharper than the ones for the case where the red filter is used solely. Thus, the absorption spectra considerably resemble the red (R) emission spectra that are distributed very sharply. By using the filters having such absorption spectra, light beams in any other wavelength ranges than those for red light, including sub-bands for red light, can be selectively absorbed, and the color purity of red-spot display light on the display screen can be improved considerably.

As is also seen from FIGS. 3A and 3B, the improvement of the color purity of the display light, that is, the effect of approximating the spectrum distributions of the display light to the emission spectrum distributions of the phosphors, can be also achieved or obtained equally for the other colors, green and blue, than red. In consequence, the color reproducibility can be improved.

Thus, according to the present embodiment, there may be provided a color cathode ray tube, whereby the contrast characteristic and luminance of the displayed image can be improved consistently, and high-quality color images can be displayed with greatly improved color purities for red, green, and blue spots.

The effective display region 12*a* of the faceplate 12 is shaped so that its thickness increases from its center toward the peripheral portion at the predetermined changing rate, that is, it is "flattened." In spite of this, the contrast characteristic and luminance of the display screen can be improved consistently, and rendered uniform throughout the area ranging from the central portion of the display screen to the peripheral portion.

It is to be understood that the present invention is not limited to the embodiment described above, and that various changes and modifications may be effected therein by one skilled in the art without departing from the scope of the invention.

Figure 6:
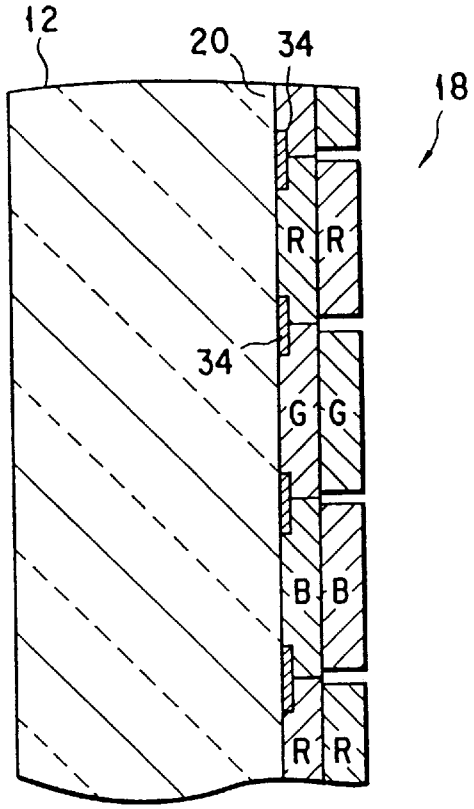
FIG. 6 is a sectional view showing a faceplate of a color cathode ray tube according to another embodiment of the invention.

For example, the correction means for correcting the properties of the individual filters of the color filter layer is not limited to the common outside filter 22 described above, and the faceplate 12 itself may be used as the correction means. As shown in FIG. 6, in this case, the common outside filter is removed, and the faceplate 12 is formed of neodymium glass.

Figure 7:
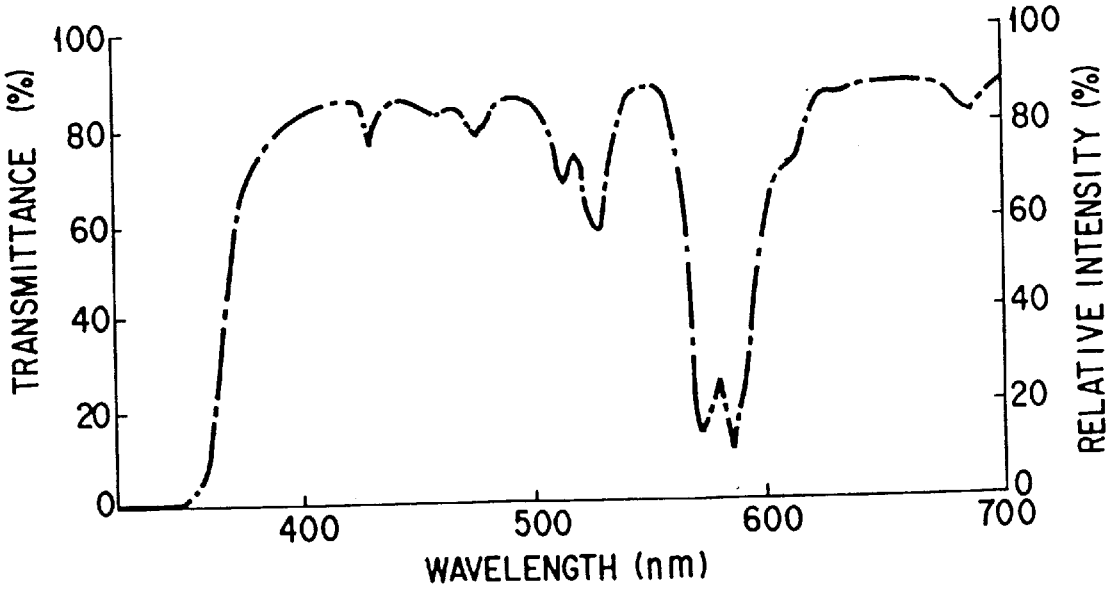
FIG. 7 shows a characteristic curve representing light absorption spectra of a neodymium glass.

As shown in FIG. 7, the faceplate 12 of neodymium glass, like the common outside filter 22, has its maximum absorption in a wavelength range near 575 nm, with which the observer's eyes can enjoy high visual-sensitivity, and has a transmittance of 60% or more for light beams with wavelengths in any other ranges.

The color cathode ray tube constructed in this manner can provide the same functions and effects of the foregoing embodiment.

What is claimed is:

1. A color cathode ray tube comprising:

an envelope including a faceplate having inner and outer surfaces, and a funnel fixed to the faceplate and having a neck;

a phosphor screen provided on the inner surface of the faceplate and including phosphor layers of three different colors arranged in a predetermined pattern;

an electron gun arranged in the neck for applying an electron beam to the phosphor screen so that the phosphor screen emits light;

a color filter layer, formed of inorganic pigment, interposed between the inner surface of the faceplate and the phosphor screen, the color filter layer including color filters of a color corresponding to at least one of the three colors of said phosphor screen, said color filters being positioned such that they oppose their corresponding color phosphor layers of said phosphor screen, the color filters having a higher transmittance for light beams with wavelengths which are in a range of ±20 nm of the maximum emission spectrum wavelength of the phosphor layers of the at least one color than for light beams with wavelengths which are outside said range and which are between 400 nm and 650 nm; and correction means arranged outside and opposite the color filter layer and having a maximum absorption in a predetermined wavelength which is outside said range, for complementing the light absorption properties of the color filters, wherein the color filter layer includes red color filters formed of pigment based on ferric oxide.

2. A color cathode ray tube according to claim 1, wherein said correction means includes an outside filter formed on the outer surface of the faceplate and common to the three color phosphor layers.

3. A color cathode ray tube according to claim 1, wherein said faceplate is formed of neodymium glass and constitutes the correction means.

4. A color cathode ray tube according to claim 1, wherein said faceplate is substantially rectangular in shape and has a thickness gradually increasing from the center thereof toward the peripheral portion at a predetermined changing rate.

5. A color cathode ray tube according to claim 1, wherein at least one of said color filters has a transmittance of 70% or more for light having a wavelength in the range of 400 to 500 nm, wherein at least one of said color filters has a transmittance of 70% or more for light having a wavelength in the range of 600 to 700 nm, and wherein said color filters have an average transmittance of 5 to 65% for light having a wavelength in a range of 500 to 600 nm.

6. A color cathode ray tube according to claim 5, wherein said correction means has the maximum absorption at a wavelength of about 575 nm and a transmittance of 50 to 90% for light having a wavelength in the maximum absorption range.

7. A color cathode ray tube according to claim 6, wherein said phosphor screen includes red phosphor layers, and said color filters include filters opposed to the red phosphor layers and having a transmittance of 70% or more for light having a wavelength of 627 nm ±20.

8. A color cathode ray tube comprising:

an envelope including a faceplate having inner and outer surfaces, and a funnel fixed to the faceplate and having a neck;

a phosphor screen provided on the inner surface of the faceplate and including red, green, and blue phosphor layers arranged in a predetermined pattern;

an electron gun arranged in the neck for applying an electron beam to the phosphor screen so that the phosphor screen emits light;

a color filter layer, formed of inorganic pigment, interposed between the inner surface of the faceplate and the phosphor screen, the color filter layer including color filters opposed individually to the phosphor layers of the phosphor screen and having colors corresponding thereto, color filters of each color having a higher transmittance for light beams with wavelengths which are in a range of ±20 nm of the maximum emission spectrum wavelength of the phosphor layers of the corresponding color than for light beams with wavelengths which are outside said range and which are between 400 nm and 650 nm; and correction means arranged outside and opposite the color filter layer and having a maximum absorption in a predetermined wavelength which is outside the maximum emission spectrum wavelengths of the red, green, and blue phosphor layers, for complementing the light absorption properties of the color filters, wherein the color filter layer includes red color filters formed of pigment based on ferric oxide.

9. A color cathode ray tube according to claim 8, wherein said correction means includes an outside filter formed on the outer surface of the faceplate and common to the three phosphor layers.

10. A color cathode ray tube according to claim 8, wherein said faceplate is formed of neodymium glass and constitutes the correction means.

11. A color cathode ray tube according to claim 8, wherein said faceplate is substantially rectangular in shape and has a thickness gradually increasing from the center thereof toward the peripheral portion at a predetermined changing rate.

12. A color cathode ray tube according to claim 8, wherein the color filters of at least one color have a transmittance of 70% or more for light having a wavelength in the range of 400 to 500 nm, the color filters of at least one color have a transmittance of 70% or more for light having a wavelength in the range of 600 to 700 nm, and said color filters have an average transmittance of 5 to 65% for light having a wavelength in the range of 500 to 600 nm.

13. A color cathode ray tube according to claim 12, wherein said correction means has the maximum absorption at a wavelength of about 575 nm and a transmittance of 50 to 90% for light having a wavelength in the maximum absorption range.

14. A color cathode ray tube comprising:

an envelope including a faceplate having inner and outer surfaces, and a funnel fixed to the faceplate and having a neck;

a phosphor screen provided on the inner surface of the faceplate and including phosphor layers of three different colors arranged in a predetermined pattern;

an electron gun arranged in the neck for applying an electron beam to the phosphor screen so that the phosphor screen emits light;

a color filter layer, formed of inorganic pigment, interposed between the inner surface of the faceplate and the phosphor screen, the color filter layer including color filters of a color corresponding to at least one of the three colors of said phosphor screen, said color filters being positioned such that they oppose their corresponding color phosphor layers of said phosphor screen, the color filters having a higher transmittance for light beams with wavelengths which are in a range of ±20 nm of the maximum emission spectrum wavelength of the phosphor layers of the at least one color than for light beams with wavelengths which are outside said range and which are between 400 nm and 650 nm; and correction means arranged outside and opposite the color filter layer and having a maximum absorption in a predetermined wavelength which is outside said range, for complementing the light absorption properties of the color filters, wherein the color filter layer includes green color filters formed of pigment based on any one of $TiO_2$—Nio—CoO—Zno, CoO—$Al_2O_3$—$Cr_2O_3$—$TiO_2$, or CoO—$Al_2O_3$—$Cr_2O_3$.

15. A color cathode ray tube comprising:

an envelope including a faceplate having inner and outer surfaces, and a funnel fixed to the faceplate and having a neck;

a phosphor screen provided on the inner surface of the faceplate and including phosphor layers of three different colors arranged in a predetermined pattern;

an electron gun arranged in the neck for applying an electron beam to the phosphor screen so that the phosphor screen emits light;

a color filter layer, formed of inorganic pigment, interposed between the inner surface of the faceplate and the phosphor screen, the color filter layer including color filters of a color corresponding to at least one of the three colors of said phosphor screen, said color filters being positioned such that they oppose their corresponding color phosphor layers of said phosphor screen, the color filters having a higher transmittance for light beams with wavelengths which are in a range of ±20 nm of the maximum emission spectrum wavelength of the phosphor layers of the at least one color than for light beams with wavelengths which are outside said range and which are between 400 nm and 650 nm; and correction means arranged outside and opposite the color filter layer and having a maximum absorption in a predetermined wavelength which is outside said range, for complementing the light absorption properties of the color filters, wherein the color filter layer includes blue color filters formed of pigment based on $Al_2O_3$—CoO.

16. A color cathode ray tube comprising:

an envelope including a faceplate having inner and outer surfaces, and a funnel fixed to the faceplate and having a neck;

a phosphor screen provided on the inner surface of the faceplate and including red, green, and blue phosphor layers arranged in a predetermined pattern;

an electron gun arranged in the neck for applying an electron beam to the phosphor screen so that the phosphor screen emits light;

a color filter layer, formed of inorganic pigment, interposed between the inner surface of the faceplate and the phosphor screen, the color filter layer including color filters opposed individually to the phosphor layers of the phosphor screen and having colors corresponding thereto, color filters of each color having a higher transmittance for light beams with wavelengths which are in a range of ±20 nm of the maximum emission spectrum wavelength of the phosphor layers of the corresponding color than for light beams with wavelengths which are outside said range and which are between 400 nm and 650 nm; and correction means arranged outside and opposite the color filter layer and having a maximum absorption in a predetermined wavelength which is outside the maximum emission spectrum wavelengths of the red, green, and blue phosphor layers, for complementing the light absorption properties of the color filters, wherein the color filter layer includes green color filters formed of pigment based on any one of $Tio_2$—Nio—CoO—Zno, CoO—$Al_2O_3$—$Cr_2O_3$—$TiO_2$, or CoO—$Al_2O_3$—$Cr_2O_3$.

17. A color cathode ray tube comprising:

an envelope including a faceplate having inner and outer surfaces, and a funnel fixed to the faceplate and having a neck;

a phosphor screen provided on the inner surface of the faceplate and including red, green, and blue phosphor layers arranged in a predetermined pattern;

an electron gun arranged in the neck for applying an electron beam to the phosphor screen so that the phosphor screen emits light;

a color filter layer, formed of inorganic pigment, interposed between the inner surface of the faceplate and the phosphor screen, the color filter layer including color filters opposed individually to the phosphor layers of the phosphor screen and having colors corresponding thereto, color filters of each color having a higher transmittance for light beams with wavelengths which are in a range of ±20 nm of the maximum emission spectrum wavelength of the phosphor layers of the corresponding color than for light beams with wavelengths which are outside said range and which are between 400 nm and 650 nm; and correction means arranged outside and opposite the color filter layer and having a maximum absorption in a predetermined wavelength which is outside the maximum emission spectrum wavelengths of the red, green, and blue phosphor layers, for complementing the light absorption properties of the color filters, wherein the color filter layer includes blue color filters formed of pigment based on $Al_2O_3$—CoO.

* * * * *